United States Patent [19]

Kraus et al.

[11] 4,019,412

[45] Apr. 26, 1977

[54] TORQUE RELEASE WRENCH

[76] Inventors: Robert A. Kraus; Edmund J. Kraus, both of 14160 Redhill Ave. No. 39, Tustin, Calif. 92680

[22] Filed: Sept. 12, 1975

[21] Appl. No.: 612,845

[52] U.S. Cl. ..... 81/52.4 R; 192/56 L

[51] Int. Cl.[2] ..... B25D 23/142

[58] Field of Search ..... 81/52.4 R, 52.5; 173/12; 335/253, 254; 192/56 L

[56] References Cited

UNITED STATES PATENTS

| | | | |
|---|---|---|---|
| 2,398,392 | 4/1946 | Page | 81/52.4 R |
| 2,667,800 | 2/1954 | Garwood | 81/52.4 R |
| 2,792,733 | 5/1957 | Walraven et al. | 81/52.4 R |
| 3,101,434 | 8/1963 | Kitscha | 335/254 |
| 3,503,021 | 3/1970 | DeBruin et al. | 335/254 |
| 3,710,674 | 1/1973 | Seccombe et al. | 173/12 |

*Primary Examiner*—James L. Jones, Jr.

[57] ABSTRACT

The invention described herein is a ratchet-type torque release wrench for the precise setting of the residual axial tension (clamping force) to be retained within a threaded fastening system under installation, wherein as the threaded fastening system's bolt attains a predetermined value of axial tension the manually perceptible spontaneous release of only a minor portion of the total torque applied to either the fastening system under installation signals to the installation operator the completion of the fastening system's installation sequence.

12 Claims, 3 Drawing Figures

TORQUE RELEASE WRENCH

BACKGROUND OF THE INVENTION

In modern fabricated structural assemblies, designed for optimum strength-to-weight ratios, as required by today's aerospace and other non-related industries comprising one or more threaded fastening systems, in which the residual axial tension to be retained within a threaded fastening systems bolt after installation, approaches close to 80% of that bolts ultimate tensil failure, it is of great importance, to be able to measure the exact torque applied to that threaded fastening system under installation, as well as to implement a failsafe means for terminating either that fastening systems bolts or nuts rotation, at the precise moment when either that bolt or nut has attained a predetermined value of torque. Even the most experienced installation operator, using only his own discretion and manual dexterity, cannot determine the proper value of torque necessary to obtain a fastening system's optimum performance.

To assign the determination of what constitutes sufficient torque, for the attainment of a threaded fastening system's optimum performance, to an installation operation depending on its own discretion and manual dexterity alone, is not advisable.

Therefore, in order to eliminate costly rejects and to prevent possible failure of structural assemblies and equipment in which the use of threaded fastening systems are prevalent, and since the use of softer materials such as aluminum and plastics are more and more accepted throughout the industries and the employment of unqualified labor rises, it becomes apparent that the precision for repeatability of a threaded fastener system under installation, must be dictated by the proper presetting, within a threaded fastening system's installation tool, thereby releaving the installation operator from his own discretion during installation.

STATE OF PRIOR ART

Torque wrenches are not new in the industries where the use of threaded fastening systems are prevalent, and the state of prior art provides a number of devices for the controlled installation of threaded fastening systems. Most of these devices measure the deflection of a bending steel bar, with the increase of applied torque, to a fastening system under installation, directly readable on a proportional scale graduated either in inch-pounds or in foot-pounds of torque. Other devices of the prior art depend on the compression of a spring to actuate via suitable arrangement an audible click as an indicator for a completed installation sequence. Still other devices employ a very minute concussion, which is manually perceptible by the installation operator, at the installation tools handle, at the moment when either the fastening systems nut or bolt attains a predetermined value of torque, indicating in this fashion the completing of the fastening systems installation sequence. At least one device known to us, as described in the U.S. Pat. No. 2,398,392, Ser. No. 574,001, H. E. Page. Apr. 16, 1946, titled "Hydraulic Torque Wrench", employs the principle of torque release at the moment when the fastening system under installation attains a predetermined value of torque, as in the operation of our own device. During a fastening systems installation sequence, in which any of the above mentioned wrenching devices are employed, except for the H. E. Page device and our own, the installation operator must exercise an extreme caution not to miss the indicator for the completing of the fastening systems installation sequence, which could easily result in overtightening of that fastening systems bolt, and subsequently cause a tensil failure of that bolt.

Our own invention device, however, as well as the H. E. Page device, does not demand the installation operators alertness as is required for use of other torque wrenches in the prior art. All of which, however including the H. E. Page device, differ greatly in their construction and philosophy of operation, when compared with that of our own device.

BRIEF DESCRIPTION OF THE DRAWINGS

Whereas.

As can be seen from the drawing, all external and internal components of the device in the embodiment FIG. 1, FIG. 2 and FIG. 3 are identical except for the difference in the annular magnet's mode of operation, and minor modification on the compound link mechanism, while most major dimensions are the same for all embodiments.

THE COMPONENTS

Figures 1, 2, 3:
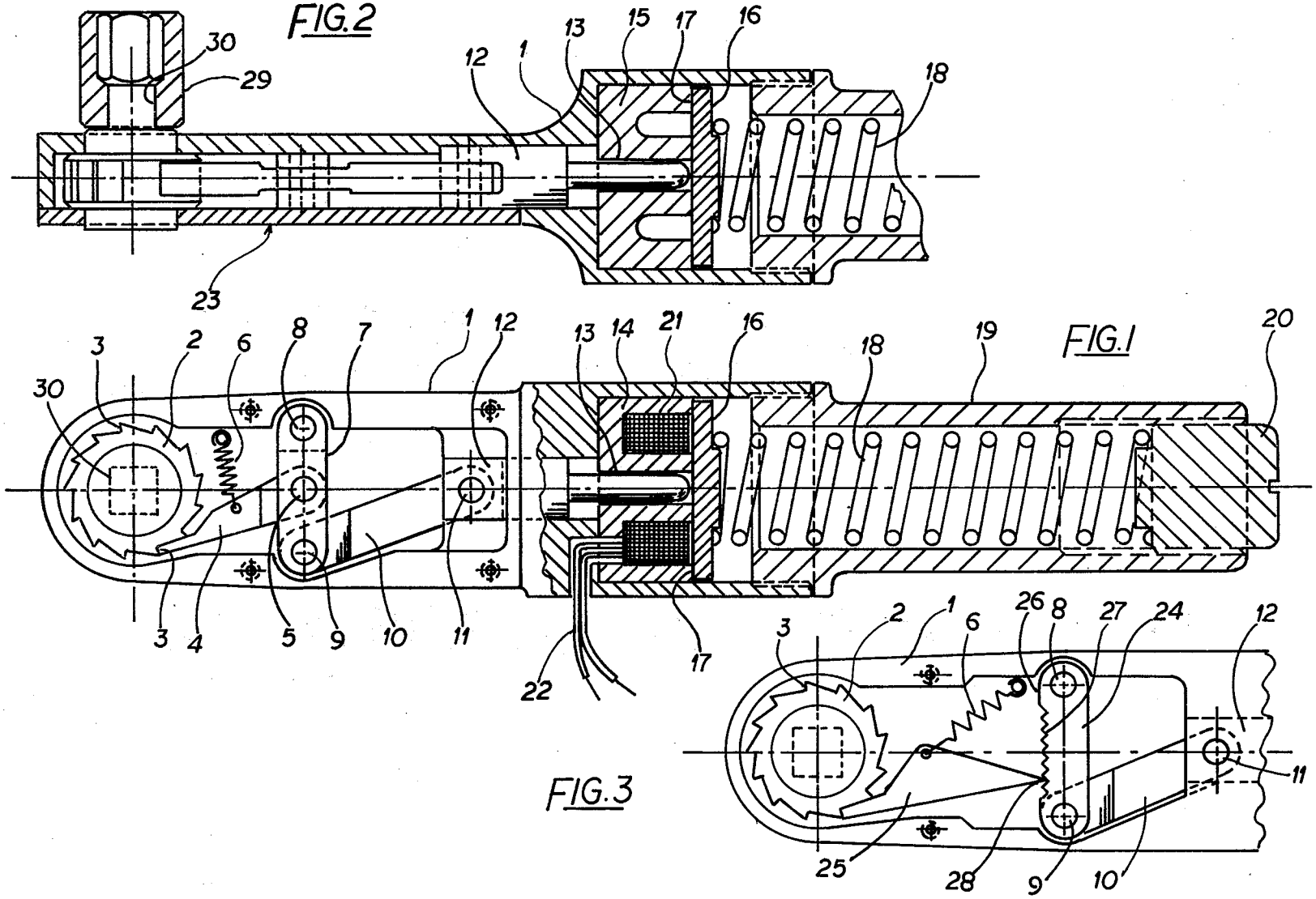
FIG. 1 is a top view of the device, showing some of the major components in their sectional view. Other components of the device are drawn, as seen from the outside of the device, with its top cover removed. Wherein, the device in FIG. 1 incorporates an annular electro magnet 14, including the solonoid coil 21 and electrical connecting leeds 22, representing one embodiment of the device.
FIG. 2 shows a side view of the device, having its front cover 23 in place, as well as incorporating an annular permanent magnet 15, in an alternate embodiment of the device in sectional view.
FIG. 3, shows a front portion of still another preferred embodiment as seen from top of the device, having its top cover removed, comprising a variable geometry compound link mechanism.

FIG. 1 shows the front housing element 1, incorporating at its front portion a ratchet wheel 2, having on its outer periphery, a series of serrations 3. A ratchet pawl 4 extends from the bearing pin 5 to the ratchet wheel's outer serrations 3, and is held engaged therewith, by the ratchet spring 6. The bearing pin 5 is located substantially at the center of the compound force dividing-link 7, which is tight via bearing pin 8 into the housing element 1. The compound dividing link 7 also includes a bearing pin 9, connecting the pushrod 10 via bearing pin 11 to the plunger 12. The plunger 12 extends through the center aperture 13, of either the annular electro magnet 14 FIG. 1, or the annular permanent magnet 15 FIG. 2 and is abutting against the magnet-plate 16. The magnet-plate 16 is located between the plunger 12 and the annular magnets pole faces 17 on one side, and the compression spring 18 on the other side.

A torque handle 19 is threadably fastened to the housing element 1, and is containing the compression spring 18, as well as the spring compression adjustment screw 20. An electro magnetical solonoid coil 21 comprising the electrical connecting terminal leeds 22 and 23 is the housing element's front cover. FIG. 3 shows an alternate compound link 24, and an alternate ratchet pawl 25. 26 represents the compound links side of serrations, 27 are a series of linear serrations and 28 is the pointed end of the ratchet pawl 25. 29 is a wrench socket to fit a corresponding nut or bolt.

CONSTRUCTION AND OPERATION OF THE DEVICE

The device in our own invention consists of a housing element 1 comprising, at its front portion, a socket drive 30 of conventional design to which is connected a wrench socket 29, which establishes a torque transmitting connection between that socket drive and either a threaded fastening systems nut or bolt. A ratchet pawl 4 is held by pawl spring 6 in tangential engagement with that socket drives outer serrations 3 in such a way, that the ratchet pawl 4 will override that socket drive's outer serrations 3, in one direction only. Wherein, in very broad terms, that ratchet pawl translates the reaction of that socket drives angular torque, into a tangential force as represented by $F_1$, which is transmitted from that socket drives outer serrations 3, over that ratchet pawl 4 to the bearing pin 5, located approximately, but not necessarily at the center of the compound force dividing link 7. That compound link's outer bearing pin 8, connects that compound link 7 to that housing element 1 in such a way that the compound link may swing, pivotly, through that bearing pin 8 and through a certain angular section of arc, within that front housing element from one side, in either direction.

The compound force dividing link mechanism, which incorporates the components 4, 5, 7, 8, 9 and 10 as well as the components in FIG. 3, for the variable arrangement represented by 24, 25, 8, 9 and 10, respectively, are important in keeping the physical dimensions of either the annular electro-magnet 14 or the annular permanent magnet 15 (whichever is used) to a minimum. Wherein the magnitude of the force $F_1$, is divided by that compound link's inherent geometrical design, into an axial force of lesser magnitude, as represented by $F_2$. The ratio of division for the force $F_1$ into the force $F_2$ is determined solely by the location of the bearing pin 5, in relation to a specific point located along a line drawn between the bearing pins 8 and 9.

The preferred embodiment, comprising the variable geometry compound force dividing mechanism, shown in FIG. 3. Side 26, of that variable compound link 24, incorporates a series of linear serrations 27 to accommodate the pointed end 28 of the ratchet pawl 25. Wherein the change in the ratio, for the division of the force $F_1$ into the force $F_2$, is accomplished simply by moving that ratchet pawl's pointed end 28 into any other serration 27 of that compound link 24, to either increase or decrease that force $F_2$, in relation to that force $F_1$, respectively.

The force $F_1$, after being divided by the compound link mechanism into a force of lesser magnitude $F_2$, is transmitted via bearing pin 9 and pushrod 10 to the bearing pin 11 of plunger 12, which extends movably through the center aperture 13 of either the annular electro magnet 14 in FIG. 3, or the annular permanent magnet 15 in FIG. 2, which are securely tied to the housing element 1, and butts against that magnet plate 16. The magnet plate 16 is located between the annular magnets pole face 17 and compression spring 18, located within the torque handle 19. The torque handle 19 represents the second housing element, which is threadably secured to the housing element 1, and incorporates at its end a spring compression adjustment screw 20. That compression spring adjustment screw 20, if adjusted to compress the spring 18 to a predetermined value of compression, represented by $F_3$, presses the magnet plate 16 against the annular magnets pole faces 17, assuring a perfect contact between the pole faces 17 and magnet plate 16. Whereby the force $F_3$, together with the magnetical attractive forces $F_4$, which are attracting the magnet plate 16 against the pole faces 17, are represented jointly by $F_5$, acting in direction toward the socket drive 30. In this position, with the magnet plate 16 pressed against the pole faces 17, the plunger 12 is movable axially within the annular magnet's center aperture 13, through a relative distance of approximately .002 to .005 of one inch in either direction, maintaining thereby a firm contact between the magnet plate 16 and the pole faces 17, with the combined forces $F_5$, in direction toward the socket drive, while the counteracting force $F_2$, acting in direction toward spring 18 on the magnet plate 16, at this moment, is zero.

Before starting a fastening systems installation sequence using the herein described installation tool, the spring adjustment screw 20 is tightened to compress the spring 18 to a predetermined value of compression $F_3$, which together with the consistent magnetical attractive force $F_4$, is equal to the translated reactive force $F_2$, for a predetermined value of angular torque, necessary in the precise setting of the residual axial tension to be retained within either a threaded fastening system's nut or bolt after installation. Thus, the installation tool is ready for use.

During the fastening systems's installation sequence, as the angular mechanical and frictional resistances increase with the tightening of either the fastening system's nut or bolt, the counteracting force $F_2$, is likewise increasing against the magnet. plate 16 in direction toward the spring 18. Thereby decreasing the differences between the two counteracting forces $F_2$ and the combined forces $F_5$, to the point of zero.

At this moment, as the threaded fastening systems angular mechanical and frictional resistances further increase, the force $F_2$, acting on the magnet plate 16 in direction toward the spring 18, exceeds the combined forces $F_5$, acting on the magnet pole faces in direction toward the socket drive. Thus, the combined forces $F_5$, acting on the magnetical pole faces 17 in direction toward the socket drive 30 can no longer support the force $F_2$, acting on the magnet plate 16 in direction toward the spring 18, which causes the magnet plate 16 to separate from the magnetic pole faces 17, to compress the spring 18 in direction toward the spring adjustment screw 20.

In the process, as the plunger 12 moves toward the spring 18, an associated angular movement between the socket drive 30 in relation to the housing element 1 is taking place, which is putting the socket drive and either the threaded fastening system's nut or bolt into stationary position relative to the fastening system's parent material, completing thereby the fastening system's installation sequence, while the installation tool is permitted to rotate further, about the fastening systems centerline, through a certain angular section of arc. During the magnet plate's separation from the magnetical pole faces 17, the magnetical attractive forces $F_4$, are rapidly decreasng by the square of the distance between the magnet plate 16 and the magnetical pole faces 17, to a point of negligible attraction between them, while the compressive force of the spring 18 increases only slightly, substracting nearly all of the force $F_3$, from the force $F_5$, which is perceptible by the installation operator through its manual dexterity as an indicator for the completing of the installation sequence.

The foregoing detailed description is to be clearly understood as given by way of illustration and example only, the spirit and scope of this invention being limited solely by the appended claims.

What is claimed is:

1. A wrenching structure, comprising along its general centerline, a compressive spring, a magnet plate, an annular magnet having pole faces, as well as a center aperture and a plunger extending through that annular magnet's center aperture, wherein that annular magnet's attractive forces together with that spring's predetermined compressive force presses that magnet plate against that annular magnet's pole faces toward that plunger, and wherein a variable force of lesser magnitude is exerted by that plunger against that magnet plate in opposing direction toward that spring, whereby as that variable force of lesser magnitude increases to a point where that variable force acting toward that spring, exceeds the combined force of that spring together with that magnetical pole faces attracting forces toward that plunger, that magnet plate will separate from that magnetical pole faces in the direction toward that spring, wherein the portion of force representing the magnetical attraction, is substracted from the combined forces of that compressive spring together with that magnetical attractive force, acting in direction toward that plunger, at the moment when that magnet plate separates from that annular magnet's pole faces in direction toward that spring.

2. A device as in claim 1, comprising at its front housing element a ratchet drive wheel, a ratchet pawl, a compound link having a center pivot and two outer bearing points, a pushrod, as well as a plunger movably extending along the device's general centerline, wherein that compound link is tied pivotly, at one end bearing point to that front housing element, substantially rectangular to that centerline, so that that ratchet pawl may extend from that ratchet drive wheel's outer serrations substantially rectangular to that compound link's center pivot, and wherein that pushrod extends pivotly from that compound link's other end bearing point to that plunger, so that, if that ratchet drive wheel is rotated in one direction, a tangential force of certain value is transmitted against that compound link's center pivot, which transmits a force of lesser value over that compound link's outer bearing point via that pushrod to that plunger, axially to that centerline.

3. A device as in claim 2, wherein a dividing link having a series of linear serrations on one of its sides, is tied pivotally with one of its outer end bearings, into that front housing element substantially ractangular to a general centerline, so, that a ratchet pawl, pointed on each of its opposing ends, may transmit a tangential first force of the given value from a ratchet drive wheel's outer serrations, to any one of that dividing links sideward located linear serrations, in contact with one of that ratchet pawl's pointed ends, whereby a second force of lesser magnitude is transmitted from that dividing link's other end bearing, via pushrod to a plunger, conveniently and slidably located along the device's general centerline, and wherein the ratio of division between that first force, of given value and that second force of lesser value can be regulated by moving that ratchet pawls pointed end, in contact with one of that linear serrations, to another serration, suitable to compliment a specific value of force at either lesser or higher magnitude.

4. A device as in claim 1, in which a compressive spring along the device's general centerline between the compression adjustment screw and the magnet plate, exerts a compressive force against that magnet plate and the annular magnet's pole faces, wherein that compressive force is predetermined, by either tightening or loosening that compression adjustment screw, and wherein that compressive force together with that magnet pole faces attractive force acting on that magnet plate and that magnet's pole faces, represents a predetermined first force in one direction, equal to a second force, acting on that magnet plate in opposite direction, and wherein that second force acting on that magnet plate, corresponds in its magnitude, to the translated reactive angular mechanical and frictional resistances of either the threaded fastening system's nut or bolt under installation, at the moment, when either that nut or that bolt attains a predetermined value of torque.

5. A wrenching tool as in claim 1 wherein at that moment, as that tool exerts a predetermined value of torque onto either a fastening system's nut or bolt under installation, that wrenching tools drive mechanism disengages partially, rendering either that nut or that bolt into stationary condition, relative to either that nut's or that bolt's parent materials, and wherein that tool design allows, a further partial rotation about that fastening system's centerline and through a certain angular section of arc, at reduced transmission of torque to either that nut or that bolt, at rest.

6. A wrenching tool as in claim 1, wherein that annular magnet a having pole faces, can either be of the permanent magnet type, or be of the electro magnetic type comprising an electrical solonoid coil.

7. A wrenching tool as in claim 3, wherein a convenient external handle is provided at that tools front housing element, to position that pointed ratchet pawl in contact with that compound links sideward located serration, to a different serration on that side of that compound link, to change the ratio of force division, through that compound link mechanism.

8. A wrenching tool as in claim 1 wherein that annular magnet is of a electro magnetic type, comprising an electrical solonoid coil, electrical terminal wires thereto, and electrical switching means.

9. A wrenching tool as in claim 4, in which the compression of that compressive spring, can be set through an adjustment of a compression adjustment screw at the rear portion of that tool.

10. A wrenching tool as in claim 2, wherein a wrench socket can be attached to that tool's socket drive.

11. A wrenching tool as in claim 2, which releases only a partial, predetermined portion of torque supplied to either a threaded fastening system's nut or bolt under installation, at that moment when either that fastening system's nut or bolt has attained a predetermined value of torque, sufficient for the proper setting of that fastening system's residual axial tension, to be retained within it's bolt, after installation.

12. A device as claimed in claim 1 in which the wrench handle incorporates a screw means, for tightening a compressable spring, wherein the value of that compression, is indicated by a indicator means at that wrench handle, and wherein that indicator means, is a vernier scale.

* * * * *